United States Patent [19]

Engelhardt et al.

[11] Patent Number: 4,995,747

[45] Date of Patent: Feb. 26, 1991

[54] PAPER STACKING APPARATUS FOR OFFICE MACHINES

[75] Inventors: Günther Engelhardt, Niederstotzingen; Gerhard Lohrmann, Thalfingen; Thomas Werner, Neu-Ulm, all of Fed. Rep. of Germany

[73] Assignee: Mannesmann Aktiengesellschaft, Düsseldorf, Fed. Rep. of Germany

[21] Appl. No.: 230,472

[22] Filed: Aug. 9, 1988

[30] Foreign Application Priority Data

Aug. 11, 1987 [DE] Fed. Rep. of Germany ..... 3727070

[51] Int. Cl.[5] ..... B41J 13/048

[52] U.S. Cl. ..... 400/625; 271/303

[58] Field of Search ..... 400/624, 625, 629, 636, 400/602, 603; 271/3, 9, 65, 279, 303

[56] References Cited

U.S. PATENT DOCUMENTS

| | | | |
|---|---|---|---|
| 766,804 | 8/1904 | Bellamy | 400/636 X |
| 2,391,760 | 12/1945 | Willard | 400/636 X |
| 4,188,025 | 2/1980 | Gusfafson et al. | 400/636 X |
| 4,220,323 | 9/1980 | Smith | 271/65 |
| 4,285,607 | 8/1981 | Steinhilber | 400/625 |
| 4,371,276 | 2/1983 | Mitrovich et al. | 400/625 |
| 4,386,864 | 6/1983 | Wang et al. | 271/65 X |
| 4,447,167 | 5/1984 | Euteneuer et al. | 400/625 |
| 4,456,239 | 6/1984 | Yamaguchi | 400/624 X |
| 4,502,805 | 3/1985 | Humbs | 400/625 X |
| 4,506,882 | 3/1985 | Ito et al. | 271/303 |
| 4,744,687 | 5/1988 | Nukaya et al. | 400/625 X |
| 4,785,942 | 11/1988 | Van Leijenhorst et al. | 271/303 X |
| 4,812,065 | 3/1989 | Shimogawara et al. | 400/624 |
| 4,822,019 | 4/1989 | Nagira | 400/624 |
| 4,854,757 | 8/1989 | Kikuchi | 271/3 |

FOREIGN PATENT DOCUMENTS

| | | | |
|---|---|---|---|
| 0054327 | 6/1982 | European Pat. Off. . | |
| 0100553 | 2/1984 | European Pat. Off. . | |
| 0142472 | 5/1985 | European Pat. Off. . | |
| 2856950 | 10/1979 | Fed. Rep. of Germany | 400/624 |
| 610701 | 10/1960 | Italy | 400/636 |
| 0169426 | 1/1986 | Japan | 400/625 |
| 0171373 | 8/1986 | Japan | 400/625 |

OTHER PUBLICATIONS

IBM Technical Disclosure Bulletin, "Paper Feed Roll Pressure Actuator and Retractor Mechanism", Kirksey et al, vol. 20 No. 11B Apr. 1978, pp. 4883–4884.

IBM Technical Disclosure Bulletin, "Nip Roller/Force Equalizing Assembly", Estabrooks et al, vol. 23 No. 3 Aug. 1980, p. 939.

*Primary Examiner*—David A. Wiecking
*Assistant Examiner*—John S. Hilten
*Attorney, Agent, or Firm*—Nils H. Ljungman, & Associates

[57] ABSTRACT

A paper stacking apparatus is for an office machine, wherein the office machine has a forward end and a rear end and includes rollers for sequentially supplying sheets of paper upwardly along a generally vertical path. The sheets extend transversely of the office machine. The path is located between the front end and the rear end. The paper stacking apparatus includes a support frame located above the rollers for sequentially supplying said sheets. A paper guide element is mounted within the support frame in alignment with the path. A forward stacker is mounted on the support frame forwardly of the paper guide element. A rear stacker is mounted on the support frame rearwardly of the paper guide element. The paper guide element is selectively movable to a forward position and to a rear position. The paper guide element at the forward position directs the sheets to the forward stacker for forward to rear stacking of the sheets thereon. The paper guide element at the rear position directs the sheets to the rear stacker for rear to forward stacking of the sheets thereon.

19 Claims, 3 Drawing Sheets

PAPER STACKING APPARATUS FOR OFFICE MACHINES

BACKGROUND OF THE INVENTION

1. Field of the Invention

This invention relates to a paper stacking apparatus for office machines and, more specifically, to such a paper stacking apparatus for printing machines such as dot matrix printers. The paper stacking apparatus includes an accessory frame located above the platen of the printer, which has a paper feed duct and angular pockets or stackers in the vicinity of the platen -for receiving single sheets after printing.

2. Description of the Prior Art

As seen in the German Patent No. DE-PS 28 56 950, the prior art forms a paper guide duct. As disclosed therein, the above-mentioned single sheets are transported tangentially to the platen and then into the stacker. In this prior art stacker, the single sheets are stacked on top of one another according to their sequential numbers (1, 2, 3, 4, etc.), so that the highest number is always on top. The disadvantage of this arrangement is that the pages must then be rearranged from top to bottom. Such a rearrangement may not be unreasonable for up to five sheets of paper, but over the long run, such rearranging is time-consuming, troublesome and expensive.

The above-mentioned patent is incorporated by reference as if the entire contents thereof was fully set forth herein.

OBJECT OF THE INVENTION

The object of the invention is therefore to provide a paper stacking apparatus which is capable of stacking the individual sheets for documents with numbered pages in ascending order, so that the finished stack of paper is in the appropriate ascending order from 1 to X, and need no longer be rearranged.

Another object of the invention is to include such a paper stacking apparatus which is also capable of providing a second stacker for conventional stacking in a reverse order for pages which are not numbered.

SUMMARY OF THE INVENTION

These and other objects of the invention are provided in a preferred embodiment including a paper stacking apparatus for an office machine. The office machine has a forward end and a rear end and includes rollers for sequentially supplying sheets of paper upwardly along a generally vertical path. The sheets extend transversely of the office machine. The path is located between the front end and the rear end of the machine. The paper stacking apparatus includes a support frame located above the rollers for sequentially supplying the sheets. A paper guide element is mounted within the support frame in alignment with the path. A forward stacker is mounted on the support frame forwardly of the paper guide element. A rear stacker is mounted on the support frame rearwardly of the paper guide element. The paper guide element is selectively movable to a forward position and to a rear position. The paper guide element at the forward position directs the sheets to the forward stacker for forward to rear stacking of the sheets thereon. The paper guide element at the rear position directs the sheets to the rear stacker for rear to forward stacking of the sheets thereon.

Additionally, the preferred embodiment includes a paper stacking apparatus for an office machine, wherein the office machine includes supply rollers for sequentially supplying sheets of paper upwardly along a generally vertical path. Each of the sheets has a front side and a back side. The paper stacking apparatus includes a support frame located above the supply rollers for sequentially supplying the sheets. A paper guide element is mounted within the support frame in alignment with the path. The paper guide element includes rollers for advancing the sheets being supplied thereto by the supply rollers. The paper guide element is selectively movable to a forward angular position and to a rear angular position. The paper guide element at the forward angular position causes the rollers for advancing the sheets to advance the sheets at a forwardly inclined angle relative to the path away from the front side of the sheets. The paper guide element at the rear angular position causes the rollers for advancing the sheets to advance the sheets at a rearwardly inclined angle relative to the path away from the back side of the sheets. A forward stacker is mounted on the support frame for receiving each sheet from the paper guide element in the forward angular position as the front side lies against the back side of the preceding one of the sheets in the forward stacker. A rear stacker is mounted on the support frame for receiving the sheets from the paper guide element in the rear angular position as the back side lies against the front side of the preceding one of the sheets on the rear stacker.

In summary, the objects are achieved by the invention, such that in the vicinity of the platen there is a forward stacker, which can pivot around a horizontal axis, and a rear stacker. Between the stackers there is a paper guide element, the orientation of which can be adjusted, whereby an adjustment of the paper guide element toward the forward stacker or the rear stacker is connected with the pivoting movement of the pivotable forward stacker. Therefore, to start stacking in ascending order 1 to X, the forward stacker need only be switched from the base or retracted position into a working or stacking position. The sheets are immediately stacked in numerical order, one after another, with the first sheet of the stack, number 1, on top.

BRIEF DESCRIPTION OF THE DRAWINGS

A preferred embodiment of the invention is illustrated in the accompanying figures and is described in greater detail below.

DESCRIPTION OF THE PREFERRED EMBODIMENTS

Figure 1:
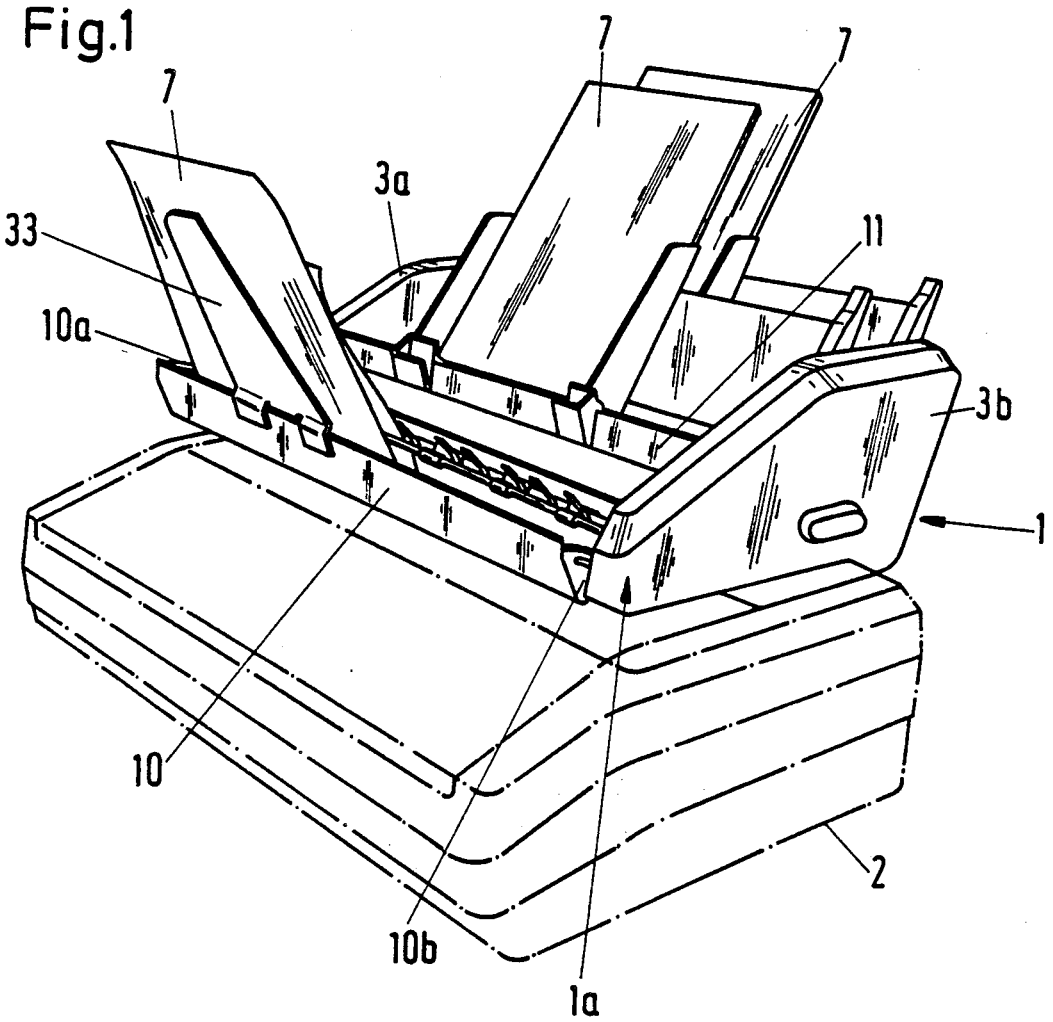
FIG. 1 shows, in perspective, a dot matrix printer with a sheet feeder accessory frame containing the preferred paper stacking apparatus of the invention.
Figure 2:
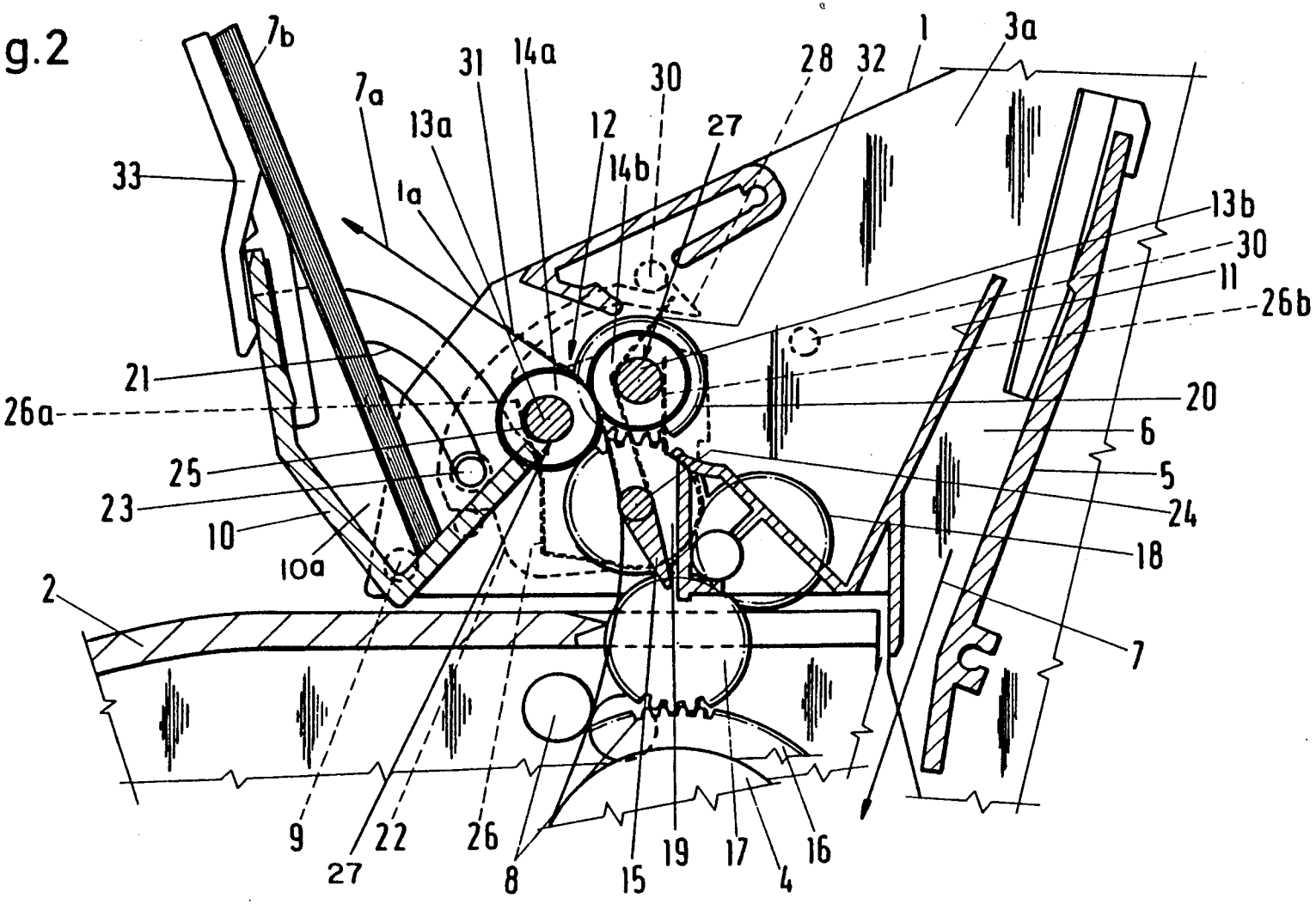
FIG. 2 shows a fragmentary, cross-sectional view of the preferred paper stacking apparatus with the forward stacker being located in the operating position.
Figure 3:
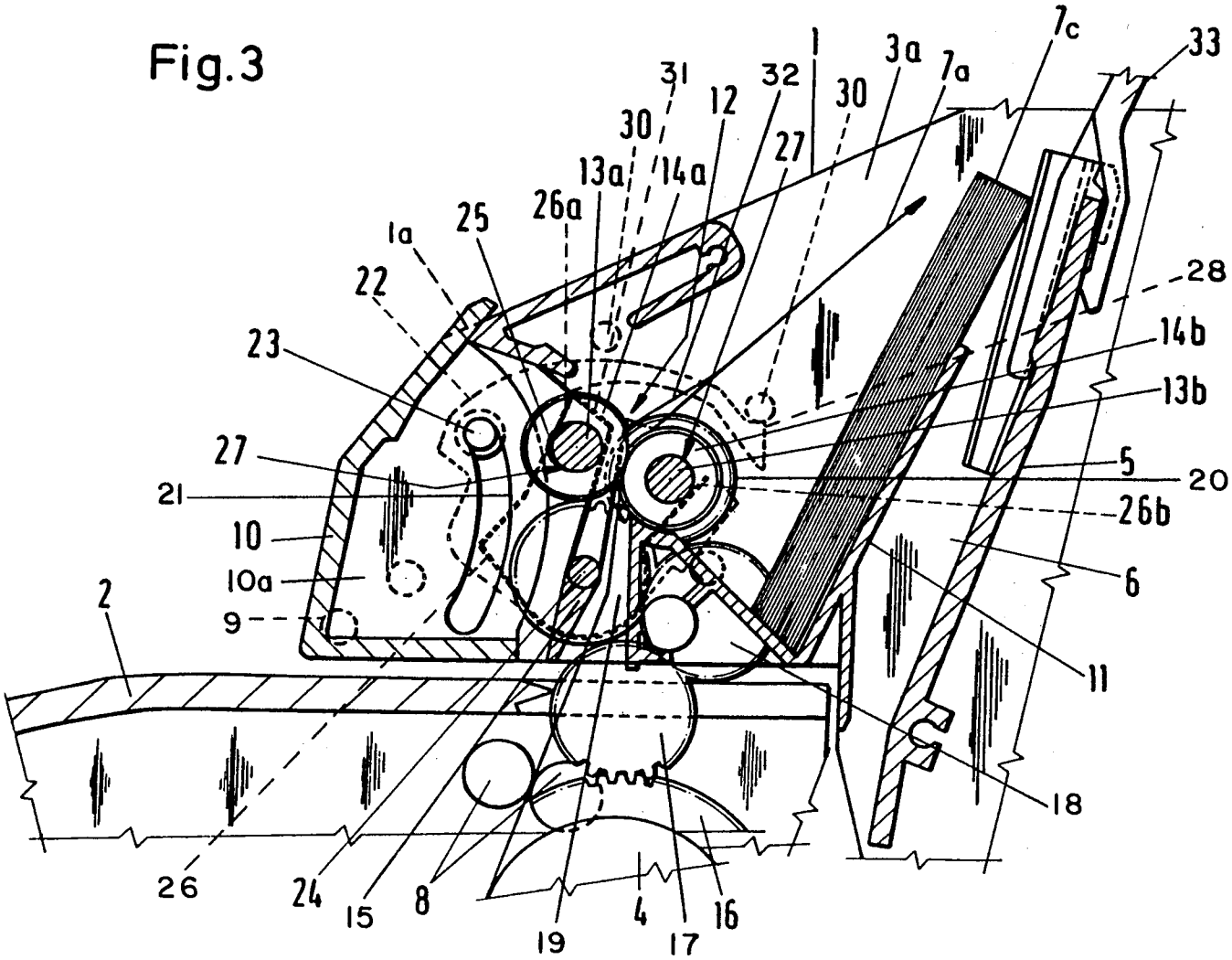
FIG. 3 shows the same fragmentary cross-sectional view of FIG. 2, with the rear stacker being located in the operating position.

As seen in FIG. 1, an accessory frame 1 is shown in an operative position on a dot matrix printer 2, which is generally shown in dotted-dashed lines. Within the accessory frame 1, a preferred paper stacking apparatus, which is described in greater detail below, is primarily located between the side walls 3*a* and 3*b* of the accessory frame 1. The accessory frame 1, as better seen in FIGS. 2 and 3, is mounted in the vicinity of the platen 4 of the printer 2. On the rear or reverse side 5 of the printer 2, there is a paper guide duct 6, through which the single sheets 7 are fed to the platen 4 for printing. Although not shown in detail, the method of supplying single sheets 7 from a plurality of sheets deposited relative to the printer 2 is well known in the printing art. As will be seen, after the sheets 7 are printed on their front side, they will be deposited in one of two pockets or stackers of the preferred stacking system.

As seen in FIG. 2, the platen 4 includes an associated pair of drive rollers 8 to sequentially guide the printed sheet 7*a* upwardly along a generally vertical path away from the platen 4. A forward stacker 10 is pivotally supported: within the frame 1 by a horizontal axis 9. The horizontal axis 9 is mounted for rotation between the side walls 3*a* and 3*b* of the frame 1. As will be seen, the frame 1 also includes a rear stacker 11. Above the platen 4 and the pair of drive rollers 8 and between the stackers 10 and 11, there is a drive gear train, which will be described in greater detail below. In connection with the drive gear train, there is a paper guide element 12, which can be selectively oriented to one of two positions, either forwardly toward the stacker 10 or rearwardly toward the stacker 11. Accordingly, depending on the position of the paper guide element 12 printed sheets 7*a* will be driven into the stacker 10 to provide a stack of sheets 7*b* or into the stacker 11 to provide a stack of sheets 7*c*. The sheets 7*b* would be sequentially stacked from front to back relative to the printer 2 while the sheets 7*c* would be sequentially stacked from back to front relative to the printer 2.

To orient the printed sheets 7*a* in relation to the individual stackers 10 or 11, the paper guide element 12 includes at least one roller pair 14*a*, 14*b* located between the stackers 10, 11. The roller pair includes driven friction rollers 14*a*, 14*b*, and at least one deflecting bar or tongue 15 is located between the driven friction rollers 14*a*, 14*b* and the platen 4. The pivoting of the forward stacker 10 is used to bring the paper guide element 12 into the desired position.

For the desired stacking of the sheets 7*a*, the drive energy needed to advance the sheets 7*a* is transmitted by means of a pair of shafts 13*a* and 13*b* which respectively include driven friction rollers 14*a* and 14*b*. As will be seen, the direction for stacking the sheets 7*a* is determined partly by the pair of friction rollers 14*a* and 14*b* and partly by a deflecting bar or tongue 15 of the paper guide element 12.

Rotation of the friction rollers 14*a* and 14*b* is provided by the above-mentioned drive gear train. The drive gear train proceeds from a gear wheel 16 on the platen 4 (a printing roller) and through a series of intermediate gears 17, 18 and 19. Gear 19 drives a gear wheel 20, which corresponds to and produces rotation of the friction rollers 14*a*, 14*b*. Although the shaft 13*b* of the friction roller 14*b* is mounted for rotation in a fixed position within the paper guide element 12 and the gear wheel 20 mounted on the end thereof, other means are provided for the shaft 13*a* to accommodate different paper thicknesses.

The forward stacker 10 is mounted with the horizontal axis 9 in the side walls 3*a* and 3*b* of the frame 1. In the non-operating or retracted position (FIG. 3), the back wall of the forward stacker 10 is in close contact or alignment with the end surface 1*a* of the accessory frame 1. An advantageous result is that the forward, pivotable, angular stacker 10 can be adjusted from the stacking position into a retracted position in which it is in close contact with the frame 1 at the end surface 1*a* thereof. Thus, the forward stacker 10 offers ergonometrically extremely favorable access to the stack of sheets 7*b*, which are in correct numerical order. In addition, the forward stacker 10 fits advantageously into the external form of the frame 1 when not in use.

The forward stacker 10 is mounted on the side walls 3*a* and 3*b* of the frame 1 for pivotal movement around the horizontal pivot axis 9. The forward stacker 10 also has a pair of end plates 10*a* and 10*b* which include guide curves 21. A pin 23 of a sole plate 22 at each end of the paper guide element 12 is guided within its respective guide curve 21. The two sole plates 22 enclose between them the shaft pair 13*a*, 13*b* with the friction rollers 14*a*, 14*b* and the tongue 15. The sole plates 22 can each pivot around a common horizontal axis 24 mounted in the side walls 3*a*, 3*b* of the frame 1. This configuration can consequently be economically designed using a simple drive gear train having a minimum number of components.

The sole plates 22, which are respectively located at opposite sides of the frame 1, basically support the shafts 13*a* and 13*b*, which in turn support the friction rollers 14*a* and 14*b*, extending therebetween. Similarly, the tongue 15 is in the form of an elongated deflecting bar which extends over the full width of the frame 1 and is mounted between the two sole plates 22. The two sole plates 22 of the paper guide element 12 can be pivoted as a unit around the common horizontal axis 24 and are mounted so that they can rotate relative to the side walls 3*a* and 3*b* of the frame 1.

Each of the sole plates 22, in addition to supporting the shafts 13*a* and 13*b*, the friction rollers 14*a*, 14*b* and the tongue 15, has the above-mentioned guide pin 23. For supporting the shaft 13*a*, each s plate 22 is also provided a slot 25, which allows a thickness-compensation movement of the corresponding friction roller 14*a*, in order to advance printed sheets 7*a* of different thicknesses. The two shafts 13*a* and 13*b* are pressed together by means of a leg spring 26, which is illustrated schematically by a double dotted line. Each of the legs 26*a* and 26*b* of the leg spring 26 is in contact with the outside circumference 27 of one of the two shafts 13*a* and 13*b*. With the leg spring 26 being always in contact with the outside circumference 27 of the shafts 13*a*, 13*b*, and the shaft 13*a* being mounted in the slot 25, which runs perpendicular to the direction of the paper path, there is continuous adjustment for different paper thicknesses between the two friction rollers 14*a*, 14*b*.

The sole plates 22 also include locking projections 28. For the two locking positions of the paper guide element 12, there are two catches 30 mounted at each side of the frame 1 in a radius at some distance from the horizontal axis 24. As discussed above, the paper guide element 12 rotates about the horizontal axis 24 for selective positioning for the forward stacker 10 or for the rear stacker 11. The tongue 15 is also mounted for selective angular positioning on the horizontal axis 24 which simultaneously forms the axis of rotation for the intermediate gear 19. There are two catches 30 in the side walls of the frame 1 for the operating or stacking position of the forward stacker 10 and for the non-operating or retracted position of the forward stacker 10.

The paper guidance into the appropriate stacker 10 or 11 is further improved by the fact that guide fingers 31 and 32 are fastened to the tongue 15. The guide fingers 31 and 32 are angled in the vicinity of the shafts 13*a*, 13*b* toward the forward stacker 10 or toward the rear stacker 11. Fastened to both sides of the tongue 15 are the flexible guide fingers 31 and 32, which are bent in the vicinity of the shaft 13*b* or of the shaft 13*a* respectively toward the rear stacker 11 or toward the forward stacker 10. They provide a specified route for each sheet 7*a*, as a function of the paper guide element 12, into the two stackers 10 and 11.

To reduce the expense of the stackers 10, 11, the stackers 10 and 11 are equipped with a paper support 33 which can be alternately set on either stacker 10, 11 in use. After the paper support 33 is removed from the forward stacker 10, 11 and it is swung inward, the paper stacking apparatus is closed and assumes its most aligned, smooth shape.

As discussed above, the preferred paper stacking apparatus for an office machine, in particular for a dot matrix printer, includes an accessory frame 1 located above the platen 4. The machine has a paper feed duct 66 and angular pockets or stackers 10, 11 for sheets 7 in the vicinity of the platen 4. In the vicinity of the platen 4, the paper stacking apparatus includes a forward stacker 10, which can pivot around a horizontal axis 9, and a rear stacker 11. Between the stackers 10, 11 there is a paper guide element 12, the direction of which can be adjusted. The adjustment of the paper guide element 12 toward the forward stacker 10 or the rear stacker 11 corresponds to and is connected with the pivoting movement of the pivotable forward stacker 10.

The paper stacking apparatus is characterized by the fact that the paper guide element 12 comprises at least one shaft pair 13*a*, 13*b* located between the stackers 10, 11. There are also driven friction rollers 14*a*, 14*b* on the shaft pair 13*a*, 13*b* and at least one tongue 15 located between the pair of friction rollers 14*a*, 14*b* and the platen 4.

The paper stacking apparatus is also characterized by the fact that the forward, pivotable, angular stacker 10 can be adjusted from the forward stacking position into a rearward position in which it is generally aligned with and in close contact with the end surface 1*a* of the frame 1.

Another feature of the invention is characterized by the fact that the forward stacker 10 is mounted on the side walls 3*a*, 3*b* of the accessory frame 1 for pivotal movement around the horizontal pivot axis 9. The forward stacker 10 also has a pair of guide curves 21, in each of which a pin 23 of a sole plate 22 of the paper guide element 12 is guided. The two sole plates 22 enclose between them the shaft pair 13*a*, 13*b* with the friction rollers 14*a*, 14*b* thereon and the tongue 15. The sole plates 22 can each pivot around a joint horizontal axis 24 and are each mounted relative to the side walls 3*a*, 3*b* of the accessory frame 1.

The invention is also characterized by the fact that a leg spring 26 is in contact with each of the outside circumferences 27 of the shafts 13*a*, 13*b* with one of the shafts 13*a*, 13*b* being mounted in a slot 25. The slot 25 runs perpendicular to the direction of the paper path in order to be able to compensate for different paper thicknesses between the two friction rollers 14*a*, 14*b*.

Still further, the paper stacking apparatus is characterized by the fact that the sole plates 22 each have an locking projection 28. There are catches 30 on the inside of the side walls 3*a*, 3*b* of the frame 1 for the forward operational position of FIG. 2 of the pivoting, forward stacker 10 and for its retracted or non-operating position of FIG. 3.

Still another feature of the invention is characterized by the fact that flexible guide fingers 31, 32 are fastened on both sides of the tongue 15. As a result, the fingers 31, 32 can be bent forward and backward in the vicinity of the shafts 13*a*, 13*b* toward the front stacker 10 or toward the rear stacker 11.

Finally, the paper stacking apparatus is characterized by the fact that there is a paper support 33 which can be inserted alternately on the stackers 10, 11.

The invention as described hereinabove in the context of a preferred embodiment is not to be taken as limited to all of the provided details thereof, since modifications and variations thereof may be made without departing from the spirit and scope of the invention.

What is claimed is:

1. A paper stacking apparatus for an office machine, said office machine having a forward end and a rear end and including means for sequentially supplying sheets of paper upwardly along a generally vertical path, said office machine having opposite sides extending from said forward end to said rear end, said sheets for being disposed transversely in said office machine to extend between said opposite sides of office machine, and said path being located between said front end and said rear end, said paper stacking apparatus comprising:

a support frame rigidly mounted on said office machine;

said support frame being located above said means for sequentially supplying said sheets;

a paper guide element pivotally mounted within said support frame in alignment with said path;

a forward stacker pivotally mounted on said support frame forwardly of said paper guide element;

a rear stacker rigidly mounted on said support frame rearwardly of said paper guide element;

said paper guide element being coupled to said forward stacker;

said paper guide element having a forward position and a rear position relative to said support frame;

said paper guide element being coupled to said forward stacker for pivotal movement of said paper guide element relative to said support frame and to said forward stacker between said forward position and said rear position in response to pivotal movement of said forward stacker relative to said support frame;

said forward stacker comprising means for generating pivotal movement of said paper guide element to said forward position for directing said sheets to said forward stacker for forward to rear stacking of said sheets thereon; and said forward stacker comprising means for generating pivotal movement of said paper guide element to said rear position for directing said sheets to said rear stacker for rear to forward stacking of said sheets thereon.

2. The paper stacking apparatus according to claim 1, wherein said forward stacker is pivotally mounted on said support frame for pivotal movement about a pivot axis, said pivot axis is located forwardly of said paper guide element, said forward stacker is coupled to said paper guide element, said forward stacker is pivoted to a stacking position for receipt of said sheets therein when said paper guide element is in said forward position and is pivoted to a retracted position when said paper guide element is in said rear position, and said forward stacker at said stacking position and said rear stacker extend upwardly from said support frame with an upwardly diverging angle between said forward stacker and said rear stacker.

3. The paper stacking apparatus according to claim 1, wherein said paper guide element is mounted within said support frame for pivotal movement relative to said support frame about a horizontal axis which is generally located in said path.

4. The paper stacking apparatus according to claim 3, wherein said paper guide element includes means for advancing said sheets from said path to a selected one of said forward stacker and said rear stacker and said means for advancing is mounted for said pivotal movement with said paper guide element.

5. The paper stacking apparatus according to claim 4, wherein said paper guide element includes paper deflecting means for deflecting said sheets from said path to said means for advancing said sheets when in said forward position and when in said rear position and said paper deflecting means is mounted for said pivotal movement with said paper guide element.

6. The paper stacking apparatus according to claim 5, wherein said means for advancing said sheets includes a of transversely extending shafts 13*a*, 13*b* having friction drive rollers 14*a*, 14*b* respectively mounted thereon, said shafts are rotatable for advancing said sheets between said friction drive rollers, and said friction drive rollers are located above said horizontal axis.

7. The paper stacking apparatus according to claim 6, wherein said paper guide element includes a sole plate 22 at each end thereof with respective ends of said shafts and said paper deflecting means mounted thereon and said sole plates are mounted for said pivotal movement about said horizontal axis.

8. The paper stacking apparatus according to claim 7, wherein at least a portion of said paper deflecting means extends below said horizontal axis and is capable of said deflecting said sheets to said friction drive rollers when said paper guide element is in said forward position and when said paper guide element is in said rear position.

9. The paper stacking apparatus according to claim 8, wherein said forward stacker is pivotally mounted on said support frame for pivotal movement about a pivot axis, said pivot axis is parallel with said horizontal axis, said pivot axis is located forwardly of said paper guide element and said horizontal axis, said forward stacker is coupled to said paper guide element, and said forward stacker is pivoted to a stacking position for receipt of said sheets therein when said paper guide element is in said forward position and is pivoted to a retracted position when said paper guide element is in said rear position.

10. The paper stacking apparatus according to claim 9, wherein said forward stacker is generally aligned with an external 1*a* surface of said support frame when said forward stacker is in said retracted position.

11. The paper stacking apparatus according to claim 9, wherein said forward stacker includes a camming slot 23 at least one end thereof, a corresponding one of said sole plates includes a guide pin 23 located within said camming slot, and said camming slot and said guide pin couple said forward stacker to said paper guide element.

12. The paper stacking apparatus according to claim 7, wherein one of said shafts 13*a* is mounted within slot means 25 in said sole plates for relative movement toward and away from the other 13*b* of said shafts, said paper guide element includes biasing means 26 for biasing said shafts toward each other, and said slot means and said biasing means enable said friction drive rollers to advance said sheets having different thicknesses.

13. The paper stacking apparatus according to claim 7, wherein at least one of said sole plates includes a locking projection 28, said support frame includes at least two catches 30, 30, and said locking projection mates with a first of said catches when said paper guide element is in said forward position and with a second of said catches when said paper guide element is in said rear position.

14. The paper stacking apparatus according to claim 8, wherein said paper deflecting means includes flexible guide fingers 15 extending generally from said horizontal axis toward said friction drive rollers for guiding said sheets therebetween.

15. The paper stacking apparatus according to claim 1, further including a paper support element which is selectively mountable on said forward stacker when said paper guide element is in said forward position and on said rear stacker when said paper guide element is in said rear position.

16. Paper stacking apparatus for an office machine, said office machine including means for sequentially supplying sheets of paper upwardly along a generally vertical path, each of said sheets having a front side and a back side, said paper stacking apparatus comprising:

a support frame rigidly mounted on said office machine;

said support frame being located above said means for sequentially supplying said sheets;

a paper guide element pivotally mounted on said support frame in alignment with said path;

said paper guide element including means for advancing said sheets being supplied thereto by said means for sequentially supplying;

said paper guide element and said means for advancing being mounted for pivotal movement relative to said support frame;

said paper guide element being selectively pivoted to a forward angular position and to a rear angular position relative to said support frame;

said paper guide element at said forward angular position for causing said means for advancing said sheets to advance said sheets at a forwardly inclined angle relative to said path away from said front side of said sheets;

said paper guide element at said rear angular position for causing said means for advancing said sheets to advance said sheets at a rearwardly inclined angle relative to said path away from said back side of said sheets;

a forward stacker pivotally mounted on said support frame for receiving each said sheet from said paper guide element in said forward angular position as said front side lies against said back side of the preceding one of said sheets in said forward stacker;

coupling means for connecting said paper guide element to said forward stacker for movement of said paper guide element responsively to movement of said forward stacker;

means for generating pivotal movement of said paper guide element relative to said support frame and to said forward stacker between said forward angular position and said rear angular position as said forward stacker pivots between said forward angular position and said rear angular position of said guide element on said support frame; and a rear stacker rigidly mounted on said support frame for receiving said sheets from said paper guide element in said rear angular position as said back side lies against said front side of the preceding one of said sheets on said rear stacker.

17. The paper stacking apparatus according to claim 16, wherein said paper guide element is mounted within said support frame for pivotal movement about a horizontal axis 24 which is generally located in said path, said means for advancing said sheets includes driven friction rollers 14*a*, 14*b* mounted on said paper guide element for advancing said sheets therebetween, and said driven friction rollers are located above said horizontal axis at a forward side thereof in said forward angular position and at a rear side thereof in said rear angular position.

18. The paper stacking apparatus according to claim 17, wherein said paper guide element includes paper deflecting means for deflecting said sheets from said path to said driven friction rollers.

19. The paper stacking apparatus according to claim 18, wherein at least a portion of said paper deflecting means extends below said horizontal axis and is capable of said deflecting said sheets to said driven friction rollers when said paper guide element is in said forward angular position and when said paper guide element is in said rear angular position.

* * * * *

UNITED STATES PATENT AND TRADEMARK OFFICE

CERTIFICATE OF CORRECTION

PATENT NO. : 4,995,747

DATED : February 26, 1991

INVENTOR(S) : Günther ENGELHARDT, et al.

It is certified that error appears in the above-identified patent and that said Letters Patent is hereby corrected as shown below:

In column 1, line 17, after 'art', delete "forms" and insert --includes--.

In column 1, line 17, after 'guide', insert --which, together with the rear wall of a stacker, forms a paper guide--.

In column 3, line 15, after 'supported', delete ":".

In column 3, line 35, after 'pair', delete "14a, 14b".

In column 3, line 58, after 'and', insert --includes--.

In column 4, line 36, after 'each', delete "s" and insert --sole--.

In column 5, line 13, after '10,', delete "11".

In column 5, line 20, delete "66" and insert --6--.

In column 5, line 20, after 'sheets', delete "7".

Column 7, claim 6, line 2, after 'a', insert --pair--.

UNITED STATES PATENT AND TRADEMARK OFFICE

CERTIFICATE OF CORRECTION

PATENT NO. : 4,995,747

DATED : February 26, 1991

INVENTOR(S) : Günther Engelhardt, et al

It is certified that error appears in the above-identified patent and that said Letters Patent is hereby corrected as shown below:

Column 7:

Claim 6, line 3, after 'shafts', delete "13a, 13b".
line 4, after 'rollers', delete "14a, 14b".
Claim 7, line 3, delete "22".
Claim 10, line 3, after 'external', delete "1a".
Claim 11, line 3, delete "23".
line 4, after 'pin', delete "23".
Claim 12, line 2, after 'shafts', delete "13a".
line 3, after 'means', delete "25".
line 4, after 'other', delete "13b".
line 5, after 'means' delete "26".

Column 8:

Claim 13, line 4, after 'catches', delete "30, 30".
line 5, after 'projection' delete "28".
Claim 14, line 3, after 'fingers', delete "15".

Column 9:

Claim 17, line 4, after 'axis', delete "24".
line 6, after 'rollers', delete "14a, 14b".

Signed and Sealed this

Twentieth Day of October, 1992

*Attest:*

DOUGLAS B. COMER

*Attesting Officer*

*Acting Commissioner of Patents and Trademarks*